United States Patent [19]

O'Leary et al.

[11] 3,952,942

[45] Apr. 27, 1976

[54] CONTINUOUS FORM MAILER WITH INTEGRAL DETACHABLE INSERT MATERIAL AND RETURN ENVELOPE

[76] Inventors: John W. O'Leary, 14 Burncoat Way, Pittsford, N.Y. 14534; Ralph C. Wicker, 218 Williams St., Geneva, N.Y. 14456; John Lewis Williams, 15 Terrace Villa, Fairport, N.Y. 14450

[22] Filed: May 15, 1975

[21] Appl. No.: 577,569

Related U.S. Application Data

[63] Continuation of Ser. No. 436,125, Jan. 24, 1974, abandoned.

[52] U.S. Cl. ..... 229/69; 229/73; 229/85

[51] Int. Cl.[2] ..... B65D 27/10

[58] Field of Search ..... 229/69, 73, 85; 282/11.5 R, 11.5 A, 22 R, 25

[56] References Cited

UNITED STATES PATENTS

| | | | |
|---|---|---|---|
| 3,062,431 | 11/1962 | Rabenold | 229/73 |
| 3,428,237 | 2/1969 | Dowen | 229/73 X |
| 3,507,519 | 4/1970 | McNabb | 229/73 X |
| 3,790,070 | 2/1974 | Schnitzer et al. | 229/69 X |

*Primary Examiner*—Stephen P. Garbe

[57] ABSTRACT

A continuous form mailer comprised of two overlying sheets of material secured together along peripheral side edges and having a transfer material interface enabling printing through the external ply onto the internal ply and being provided with an integral return envelope portion and detachably removable invoice-receipt portion and an insertable return stub material portion. The latter portions being integral with the second of the two overlying plies. The assembly being capable of being snapped apart to separate the envelope from the invoice-receipt and return stub portions.

7 Claims, 5 Drawing Figures

CONTINUOUS FORM MAILER WITH INTEGRAL DETACHABLE INSERT MATERIAL AND RETURN ENVELOPE

This is a continuation of application Ser. No. 436,125, filed Jan. 24, 1974 now abandoned.

BACKGROUND OF THE INVENTION

Prior art continuous business form such as continuous form mailers are widely produced in a variety of sizes, shapes and outline configurations. Some mailers include return envelopes which are initially stuffed with insert material such as advertising copy, etc., other mailers include a multiplicity of forms such for example as invoices, receipts, and reminders of one form or another.

Many prior art types of mailers of a single sheet construction which necessarily require an initial folding operation prior to use so as to place the sheet in the configuration required for mailing to the ultimate consumer. Such folding operations utilize and require expensive equipment which tend to be limited to specific size formats.

Some prior art types of mailers not only are folded prior to use but include two, three, or more sheets of material, some of which must be interleaved with transfer material such as carbon paper, all of which increases the operational handling steps required to fabricate the ultimate product. Needless to say, this increases the cost of the finished piece.

Most of the prior art mailers are complicated and costly to fabricate due to the involved construction and thus they do not find popular appeal even though the need for a simple continuous form mailer is fairly wide spread in the industry.

SUMMARY OF THE INVENTION

The business form mailer of the present invention comprises a pair of oppositely disposed confronting sheets of relatively thin material, for example, paper stock which are overlaid together from continuous parallel webs of material. The lower of the two sheets which comprises the back of the outgoing mailer as well as the back of the return mailer is subdivided into an envelope back portion and an insert return portion separated by tear lines formed as a series of perforations. The upper one of the two sheets of material which comprises the front of the outgoing mailer as well as the front of the return mailer is divided into two portions separated by tear lines such as perforations which divide the return envelope from the outgoing envelope. One face of the upper sheet is carbonized or provided with a carbonless transfer material permitting the printing which is produced on the outer face of the outgoing envelope to be impressed on the upper surface of the interface of the second sheet which latter sheet forms the return material as well as the receipt for the mailed material.

The second sheet is printed on the inside surface only and provides a billing notice and a perforated stub the latter to be returned to the sender with the payment, for example, a check enclosed. At the juncture of the two sections of the second sheet a narrow space is provided adjacent the tear perforations on which adhesive material, such for example, as remoistenable glue or a peel away adhesive coated tape is applied. The tape prevents the two pieces of material from sticking together but when received by the person to whom it is addressed and after separation of the parts to form the envelope the taped area becomes a flap and the peel away material is removed exposing a line of glue enabling the return envelope to be sealed at this point.

The completed assembly is permanently glued in the area of the return envelope portion and is temporarily glued as by glue spots in the area of the addressee and the bill and receipt portion of the mailer. The perforation which separates the return envelope from the bill and receipt portion on the front sheet is offset from the perforated portion of the second sheet so that when the return envelope is removed from the assembly the flap portion which remains can be sealed for its return mailing to the original sender.

Further objects features and the intended advantages of the invention will be apparent with reference to the following specification and drawing.

DESCRIPTION OF THE PREFERRED EMBODIMENT OF THE INVENTION

Figure 1:
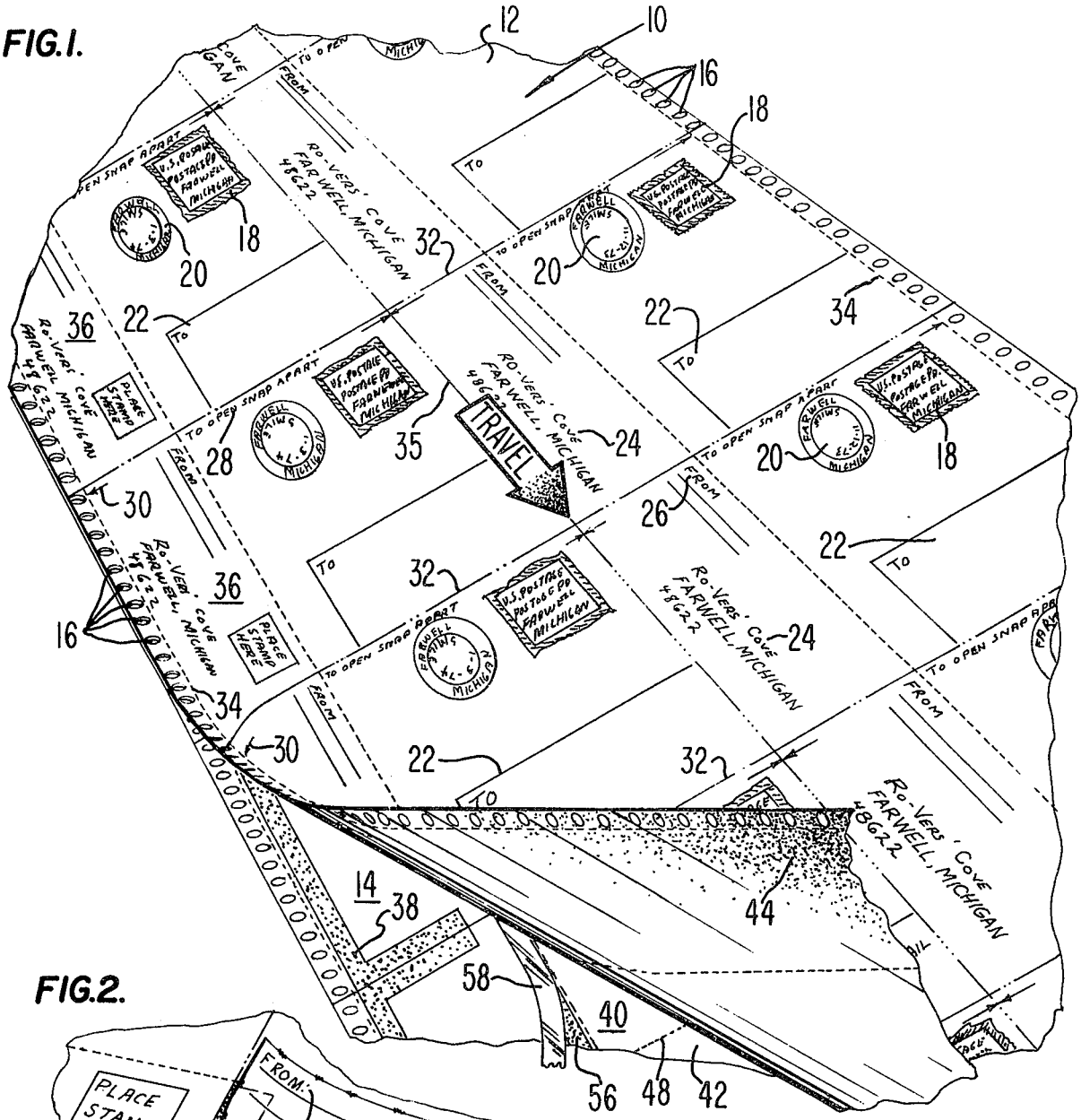
FIG. 1 is an enlarged isometric view of the upper and lower sheets of the material forming the continuous form mailer of the present invention.
Figure 2:
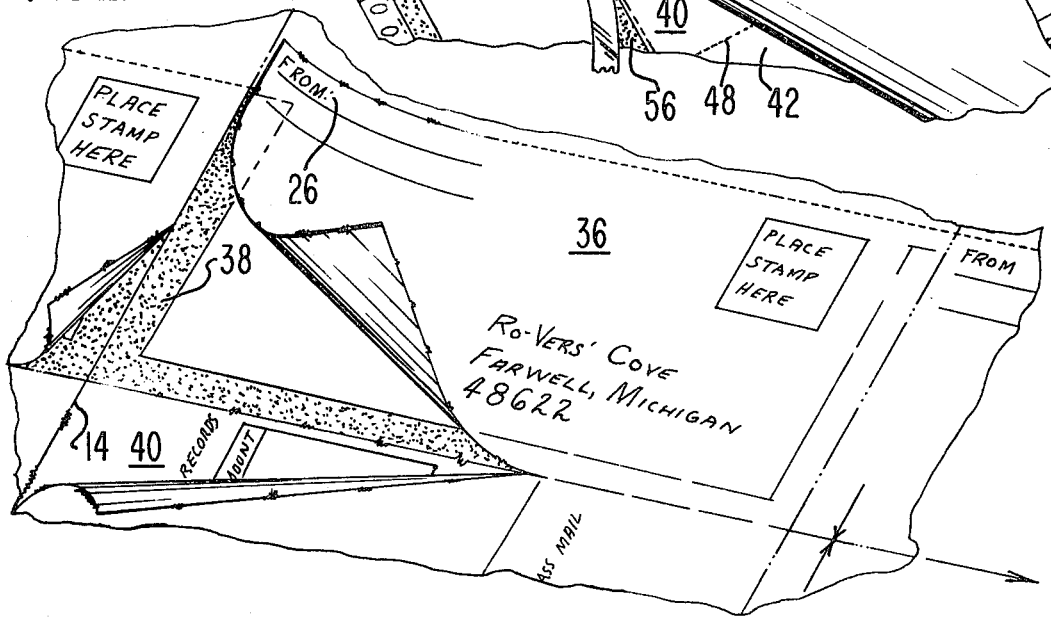
FIG. 2 is a detail view of a portion of the continuous form mailer of FIG. 1 showing the glue line used in fabricating the return envelope.

A continuous form mailer 10, including billing notice-invoice, return stub and return free mailer envelope in accordance with the present invention is seen by reference to FIGS. 1 and 2 of the drawings to be fabricated from an upper top sheet 12 of paper or other suitable material and a lower underlying bottom sheet 14 of similar material. Sheets 12 and 14, as seen in FIG. 1, are continuous webs the opposite parallel edge portions of which are provided with a series of feeder holes 16 which are provided for use with the tractor feed mechanism employed in the fabrication of the continuous form mailer as well as with the computer printer which is used to print the intelligence data on the continuous form after the form has been constructed.

The upper surface of sheet 12 is or may be printed with the United States Post Office franking privilege 18, post office mark 20, the addressee block 22 entitled "To" for the insertion of the addressee's address, the address of the sender 24 and the lines 26 entitled "From" for insertion of the return address. Since this novel mailer is of the "snap apart" type the instruction 28 "To Open Snap Apart" and the oppositely pointed arrows 30 is printed on the sheet 12 as indicated in FIG. 1. Because it is more economical to produce the continuous mailers in large numbers, since the higher the volume the lower the cost, in the illustration of FIG. 1 the mailers are shown in what is described as a "two-up" configuration with each mailer disposed adjacent to a similar mailer transversely across the web and with the mailers being serially attached longitudinally along the length of the web. Lines of perforations 32 are provided to permit pairs of mailers to be separated from the web or to aid in fan folding the web prior to further handling and/or printing. Additionally, perforations 34 are provided adjacent the line of tractor holes 16 permitting the tractor hole areas to be removed from the mailer assemblies prior to mailing to the recipient. Perforations 35 at right angles to perforations 32 permit the side by side mailers 10 to be separated into individual units for mailing.

Figure 3:
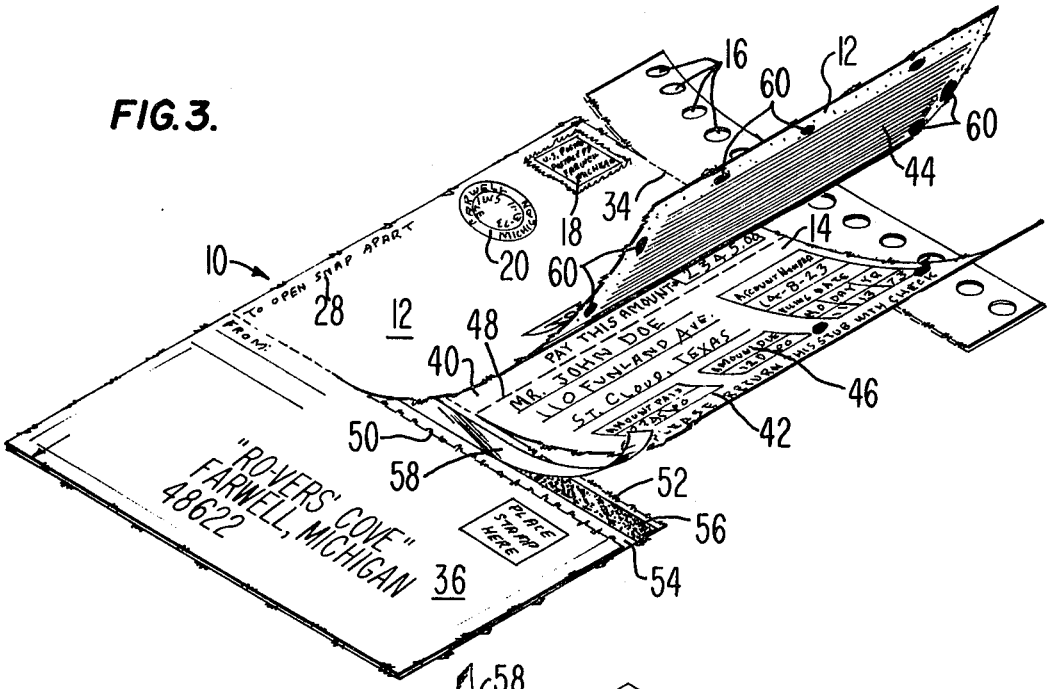
FIG. 3 is an isometric view partially broken away to expose both the inside and outside portions of the continuous form mailer.

The construction, according to the present invention, although comprising only two sheets of paper provides an integral return envelope 36 formed by the upper and lower sheets 12 and 14 by having a "U" shaped glue line 38 of permanent glue applied to the edge portion of each of the mailers as seen most clearly in FIG. 2. Application of the glue line is part of the continuous form fabrication operation while the two webs 12 and 14 are disposed in confronting parallel arrangement and attaches the upper sheet 12 to the lower sheet 14 in the area forming the return envelope portion 36 of the mailer. The mailer 10 FIG. 3 includes an invoice or bill portion 40 and a return stub 42 both portions of which are printed on sheet 14 as part of the web sheet fabricating operation. Since the data which is printed on the invoice and stub portion of the mailer varies from customer to customer or user to user and inasmuch as this material is constantly being updated by the data handling system used, such for example as a computer, transfer means 44 e.g. carbon paper, carbonless transfer material, etc., is provided as seen in FIGS. 1 and 3 to permit the printing/recording device to print through the upper sheet 12 to the front of bottom sheet 14 in the area of the invoice and stub to apply thereto the data 46. The invoice and return stub area of sheet 14 is divided by a transverse perforation line 48 which separates the invoice 40 from the return stub 42 permitting the stub 42 to be removed for further handling, as will be described later on.

As earlier mentioned herein, the present continuous form return mailer is designed to snap-apart when used so that the handling is reduced to a bear minimum and so as to permit simple, easy and efficient access to the contents of the assembled mailer unit. To this end each of the two sheet webs 12 and 14 is provided with a line of perforations 50 and 52 respectively as seen most clearly in FIG. 3. The two lines of perforations are offset from each other by a sufficient distance to provide a flap portion 54 for integral envelope 36. Adhesive material 56, such for example as rewettable or remoistenable glue, is applied to the flap area 54 during the fabricating operation. As seen in FIG. 3, a covering tape 58 may be employed to cover the glue line 56 for the return envelope flap.

It is assumed that the recipient will receive the mailer 10 in the form shown in FIG. 3 minus the tractor hole edge portion 16. The invoice and return stub portions 40 and 42 are removed from the return envelope portion 36 by grasping the mailer between both hands and snapping along the indicated tear lines 50 and 52 exposing and separating the integral return envelope 36 from the balance of received material. Spots of adhesive 60 are disposed around the periphery of the sheet 12 or 14 as the case may be, permit the two sheets to be easily separated.

Removal of the upper sheet 12 bearing the addressee's address from the lower sheet 14 will expose to view the invoice 40 and the return stub 42. After consideration by the recipient, should this be a bill, a check 62

Figure 4:
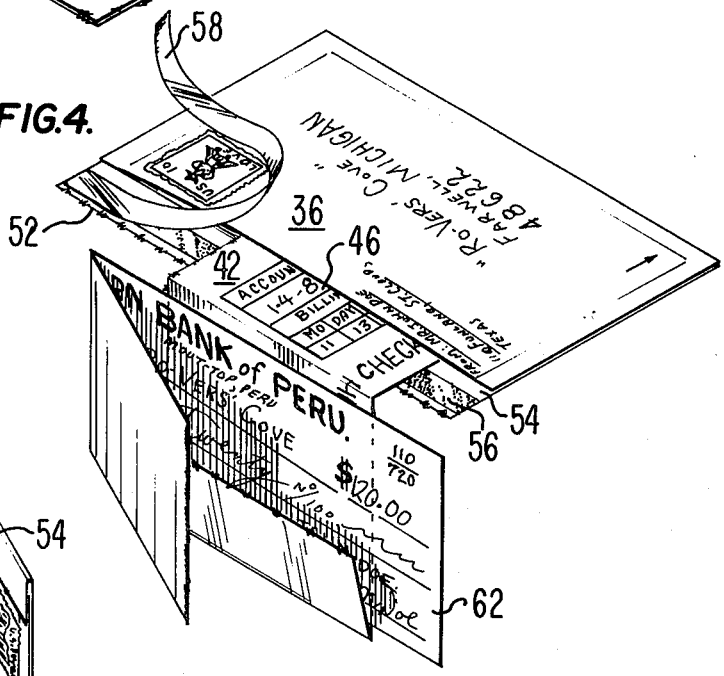
FIG. 4 is an exploded isometric detail view of the return mailer illustrating the manner in which the return stub portion and payment is utilized; and, FIG. 5 is an isometric view of the sealed return envelope ready to be mailed back to the sender.
Figure 5:
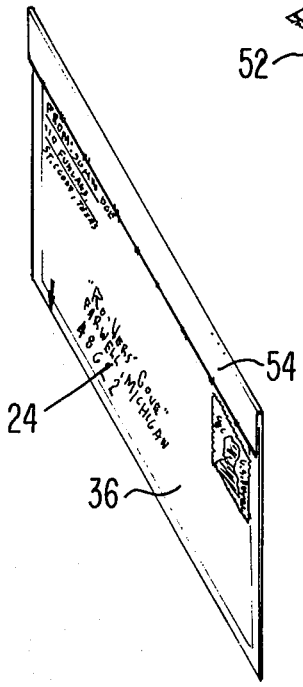

FIG. 4, will be made out to the creditor by the debtor in the amount indicated on the stub 42 of the invoice after which the check 62 and the detached stub 42 are inserted in the return envelope 36. The tear tape 58 over the glue line 56 is removed or the glue wetted as the case may be, and the envelope flap 54 is folded over the top of the envelope to seal the same as shown in the completed return assembly of FIG. 5.

What is claimed is:

1. A continuous form mailer including an invoice, return stub and integral return mailing envelope comprising:

a first continuous upper web of material adapted for receiving intelligible data thereon;

a second continuous lower web of material capable of receiving intelligible data thereon;

means forming a transfer surface for said mailer effective to transfer printed intelligible data applied to said first web through said first upper web to the confronting surface of the adjacent second lower web;

separable tractor hole area means at the side edge of said webs for mounting said first and second continuous webs in substantial parallel confronting alignment while said form is printed;

an upper separation line parallel to said side edge dividing said first continuous upper web into easily separable segments including an easily detachable return area portion on said first web forming one half of a return envelope;

an lower separation line parallel to said upper separation line dividing said second lower web into easily separable segments including an easily detachable return area portion forming the other half of said return envelope;

means bonding said first and second webs together about three edges thereof in the return area portion of said envelope so that both halves of said return envelope are adapted for being formed into a full integral envelope assembly, and means to close and seal the return envelope; and means bonding said webs together in the remaining confronting non-return areas at a portion of the confronting surface areas thereof, and a transverse separation line on said second web perpendicular to said side edge permitting said invoice and said return stub to be separated and wherein said upper and lower separation lines dividing said continuous webs into separable segments are offset parallel lines of perforations straddling an area forming said means to close and seal said return envelope.

2. The invention in accordance with claim 1 wherein said offset parallel lines of perforations permitting the assembly to be snapped apart therealong separating said envelope assembly into a return envelope and an invoice with a return stub, define a flap area which, together with a glue line applied thereto, comprise said means to close and seal said return envelope.

3. The invention in accordance with claim 1 wherein said transfer surface comprises a carbonless transfer material.

4. The invention in accordance with claim 1 wherein said transfer surface comprises carbon tissue material.

5. The invention in accordance with claim 1 wherein said means to close and seal said return envelope assembly is a moistenable or rewettable glue line applied to a flap area of said lower web adjacent said lower separation line.

6. The invention in accordance with claim 5 wherein demountable cover means overlies said glue line preventing the same from being accidentally employed prior to utilization of said envelope assembly.

7. The invention in accordance with claim 6 wherein said upper and lower separation lines dividing said webs comprise perforations transverse to the side edge dimension of said webs, said first and second lines of perforations being offset from one another, and said traverse separation line being displaced from the center of said second web and normal to said offset lines of perforations whereby said third traverse separation line of perforations divides said web into an envelope portion and an invoice-receipt and return stub portion, the return stub portion being dimensioned to be readily inserted into the return envelope portion.

* * * * *